US011343887B2

(12) United States Patent
Li

(10) Patent No.: US 11,343,887 B2
(45) Date of Patent: May 24, 2022

(54) ADAPTIVE BLEEDER CONTROL METHOD AND CIRCUIT

(71) Applicant: SHENZHEN SUNMOON MICROELECTRONICS CO., LTD., Shenzhen (CN)

(72) Inventor: Zhaohua Li, Shenzhen (CN)

(73) Assignee: SHENZHEN SUNMOON MICROELECTRONICS CO., LTD., Shenzhen (CN)

( * ) Notice: Subject to any disclaimer, the term of this patent is extended or adjusted under 35 U.S.C. 154(b) by 29 days.

(21) Appl. No.: 17/008,651

(22) Filed: Sep. 1, 2020

(65) Prior Publication Data

US 2021/0204374 A1 Jul. 1, 2021

(30) Foreign Application Priority Data

Dec. 27, 2019 (CN) ..... 201911378901.3

(51) Int. Cl.
*H05B 45/14* (2020.01)
*H05B 45/3575* (2020.01)
*H05B 45/34* (2020.01)

(52) U.S. Cl.
CPC ..... *H05B 45/14* (2020.01); *H05B 45/34* (2020.01); *H05B 45/3575* (2020.01)

(58) Field of Classification Search
CPC .... H05B 45/14; H05B 45/34; H05B 45/3575; H02M 1/4233
See application file for complete search history.

(56) References Cited

U.S. PATENT DOCUMENTS 4,870,534 A * 9/1989 Harford ..... H02H 9/005 361/58
6,856,101 B1 * 2/2005 Hitchcock ..... H05B 41/42 315/186
10,375,775 B1 * 8/2019 Li ..... H05B 47/28
2001/0054887 A1 * 12/2001 Baretich ..... H02M 5/293 323/284

(Continued)

FOREIGN PATENT DOCUMENTS

WO WO-2019233489 A1 * 12/2019 ..... H05B 33/08

*Primary Examiner* — Abdullah A Riyami
*Assistant Examiner* — Syed M Kaiser
(74) *Attorney, Agent, or Firm* — Kilpatrick Townsend & Stockton LLP

(57) ABSTRACT

Embodiments of the present application disclose an adaptive bleeder control method and circuit, the method including: acquiring a peak characterizing voltage of a grid, wherein the peak characterizing voltage is a voltage value that characterizes a peak state among the grid characterizing voltages that are detected within a preset time and being scaled in proportion to the magnitude of the grid voltage; generating a switch control signal according to the peak characterizing voltage; performing switch control according to the switch control signal to generate a bleeder signal; and performing bleeder control on a light source device according to the bleeder signal to connect or disconnect a loop with a SCR in the light source device. In the present application, the dimming function of the light source device while preventing the bleeder current path from being constantly closed and reducing system efficiency may be implemented.

9 Claims, 5 Drawing Sheets

(56) References Cited

U.S. PATENT DOCUMENTS

| | | | | |
|---|---|---|---|---|
| 2003/0052658 | A1* | 3/2003 | Baretich | H02M 5/293 323/284 |
| 2007/0052397 | A1* | 3/2007 | Thompson | H02M 5/293 323/223 |
| 2018/0310376 | A1* | 10/2018 | Huang | H05B 45/10 |
| 2019/0208591 | A1* | 7/2019 | Chen | H05B 45/10 |
| 2019/0313498 | A1* | 10/2019 | Chen | H05B 45/31 |

* cited by examiner

ADAPTIVE BLEEDER CONTROL METHOD AND CIRCUIT

CROSS-REFERENCE TO RELATED APPLICATION

The present application claims the priority of Chinese Patent Application No. 201911378901.3 filed on Dec. 27, 2019, the entire content of which is incorporated herein by reference.

FIELD

The embodiment of the present application relates to the field of power electronics technologies, in particular to an adaptive bleeder control circuit and method.

BACKGROUND ART

Silicon controlled rectifier (SCR) dimming is a commonly used dimming method. SCR dimmers use phase control methods to achieve dimming, that is, controlling an SCR dimmer to be conducted every half cycle of sine wave to obtain a same conducted phase angle. By adjusting a chopping phase of an SCR dimmer, the conducted phase angle can be changed to achieve dimming.

In a control system of an electronic circuit, when an SCR is connected, the minimum sustaining current is required when the SCR is conducted. If the system current is less than the minimum sustaining current, the SCR would be turned off. In one embodiment, in the field of LED dimming, especially the field of LED dimming in which SCR dimming is introduced, when a grid voltage is less than an LED conducted voltage, it is necessary to maintain normal operating of the SCR, and an additional bleeder current needs to be introduced to maintain the normal operating of the SCR. If a bleeder current path is persistently closed, system efficiency will be affected.

SUMMARY OF THE DISCLOSURE

Embodiments of the present application provide an adaptive bleeder control circuit and method, which aims to solve the above problem that system efficiency is affected.

Embodiments of the present disclosure concept provide solutions to one or more of: an adaptive bleeder control method, including:

- obtaining a peak characterizing voltage of a grid, wherein the peak characterizing voltage is a voltage value that characterizes a peak state among grid characterizing voltages detected within a preset time and being scaled in proportion to magnitudes of grid voltages;
- generating a switch control signal according to the peak characterizing voltage;
- performing switch control according to the switch control signal to generate a bleeder signal; and
- performing bleeder control on a light source device according to the bleeder signal to connect or disconnect a loop with a SCR in the light source device.

In one embodiment, the way of obtaining the peak characterizing voltage of the grid includes:

- storing energy by using an energy storage component while obtaining a grid voltage value;
- discharging by the energy storage component when the grid voltage is less than a preset input voltage value, to lock the peak characterizing voltage of the grid voltage; and
- using an output voltage of the energy storage component as the peak characterizing voltage.

In one embodiment, the way of generating a switch control signal according to the peak characterizing voltage, includes:

- comparing magnitudes of the grid voltage with the peak characterizing voltage; and
- outputting switch control information based on a preset rule according to a comparison result, wherein the switch control signal includes a high level or a low level.

In one embodiment, the way of performing switch control according to the switch control signal to generate a bleeder signal includes:

- turning on or turning off the switch according to the received high level or low level;
- outputting the bleeder signal according to a conduction or disconnection of a loop current while turning on or turning off the switch.

In one embodiment, the way of performing bleeder control on the light source device according to the bleeder signal, includes:

- when the loop current is conducted, the bleeder device and the SCR in the light source device form a conducting loop; and
- when the loop current is disconnected, the bleeder device and the SCR in the light source device does not form a loop.

One embodiment of the present application discloses an adaptive bleeder control circuit, includes:

- a peak value detection device configured to detect a peak characterizing voltage of a grid, wherein the peak characterizing voltage is a voltage value that characterizes a peak state among grid characterizing voltages detected within a preset time and being scaled in proportion to magnitudes of grid voltages;
- a control device connected to the peak detection device, for generating a switch control signal according to the peak characterizing voltage;
- a switch device connected to the control device and configured to receive the switch control signal from the control device, perform switch control, and generate a bleeder signal; and
- a bleeder device connected to the switch device, and configured to receive the bleeder signal generated by the switch device, and perform bleeder control on the light source device to connect or disconnect a loop with a silicon controlled rectifier (SCR) in the light source device.

In one embodiment, the peak detection device includes:

- a voltage detection device, configured to detect a grid voltage;
- a voltage lock device, connected to the voltage detection device, and configured to lock a peak characterizing voltage of the grid voltage and output the peak characterizing voltage under a preset condition; and;
- a voltage follower device, connected to the voltage lock device, and configured to follow and output the peak characterizing voltage output by the voltage lock device.

In one embodiment, the voltage detection device includes a first resistor, a second resistor and a first diode, the voltage lock device includes a first capacitor, a first MOS transistor, a first comparator, a third resistor, and a fourth resistor, and the voltage follower device includes a first voltage follower, and wherein, a first end of the first resistor is connected to the grid voltage, and a second end of the first resistor is respectively connected to an anode of the first diode and a first end of the second resistor, a second end of the second resistor is grounded, a cathode of the first diode is respectively connected to a first end of the first capacitor, a drain end of the first MOS transistor and a positive-phase input end of the first voltage follower, a second end of the first capacitor is grounded, a source of the first MOS transistor is grounded, and a first gate of the first MOS transistor is connected to an output end of the first comparator, the positive-phase input end of the first comparator is connected to a preset input voltage, and the negative-phase input end of the first comparator is respectively connected to a second end of the third resistor and a first end of the fourth resistor, the first end of the third resistor is connected to the grid voltage, the second end of the fourth resistor is grounded, the negative-phase input end of the first voltage follower is connected to the output end of the first voltage follower, and the output end of the first voltage follower is connected to the control device.

In one embodiment, the control device includes a second comparator, a fifth resistor, and a sixth resistor, wherein a negative-phase input end of the second comparator is connected to the output end of the first voltage follower, the positive-phase input end of the second comparator are respectively connected to a second end of the fifth resistor and a first end of the sixth resistor, a first end of the fifth resistor is connected to the grid voltage, a second end of the six resistor is grounded, and an output end of the second comparator is connected to the switch device.

In one embodiment, the switch device includes a second MOS transistor, wherein a gate of the second MOS transistor is connected to the output end of the second comparator, and a source of the second MOS transistor is connected to a light source device, and a drain of the second MOS transistor is connected to the bleeder device.

In one embodiment, the bleeder device includes a second voltage follower and a third MOS transistor, wherein a positive-phase input end of the second voltage follower is connected to a reference voltage, an output end of the second voltage follower is connected to a gate of the third MOS transistor, a source of the third MOS transistor is respectively connected to the negative-phase input end of the second voltage follower and a drain of the second MOS transistor, and a drain of the third MOS transistor is connected to the light source device to form a loop with the SCR in the light source device.

THE DESCRIPTION OF DRAWINGS

Embodiments of the present application are described in the following will briefly introduce the accompanying drawings used in the description of the embodiments. The accompanying drawings in the following description are only some embodiments of the present application.

DETAILED DESCRIPTION OF THE EMBODIMENTS

Embodiments of the present application will be described in conjunction with the accompanying drawings in the embodiments of the present application.

In some processes described in the specification and claims of the present application and the above drawings, multiple operations appearing in a specific order are included, but it should be understood that these operations may not be executed in the order in which they appear in this document or executed in parallel, the sequence numbers of operations, such as 101, 102, etc., are only used to distinguish different operations, and the sequence numbers themselves do not represent any execution order. In addition, these processes may include more or fewer operations, and these operations may be executed sequentially or executed in parallel. It should be noted that the descriptions of "first" and "second" in this document are used to distinguish different messages, devices, devices, etc., and do not represent a sequence, nor do not limit that the "first" and "second" are different types.

Embodiments of the present application will be described below in conjunction with the accompanying drawings in the embodiments of the present application. The described embodiments are only a part of the embodiments of the present application instead of all the embodiments.

Figure 1:
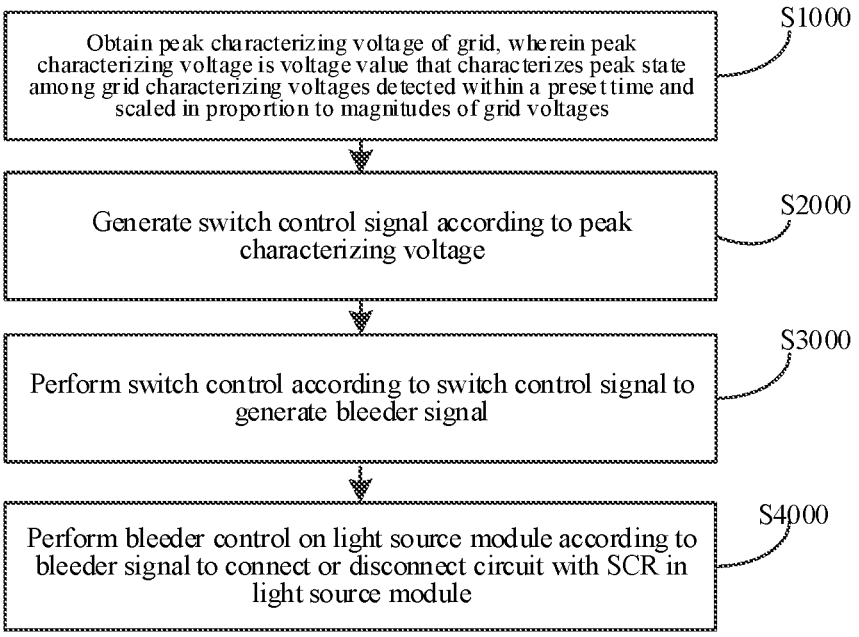
FIG. 1 is a flowchart of the adaptive bleeder control method of the present application.

Referring to FIG. 1 for details, FIG. 1 is a schematic diagram of the adaptive bleeder control method of this embodiment.

As shown in FIG. 1, an adaptive bleeder control method is disclosed, includes:

S1000: obtaining a peak characterizing voltage of a grid, wherein the peak characterizing voltage is a voltage value that characterizes a peak state among grid characterizing voltages detected within a preset time and scaled in proportion to magnitudes of grid voltages;

The grid is the connected voltage grid of the adaptive bleeder control circuit of the present application. Taking the adaptive bleeder control circuit of the present application connected to the main supply (power frequency alternating current, AC) as an example, the grid refers to the main supply grid, and the grid voltage is the main supply voltage. The peak characterizing voltage refers to the voltage value that characterizes the peak state among the grid characterizing voltages that are detected within a preset time and scaled in proportion to magnitudes of grid voltages.

Figure 2:
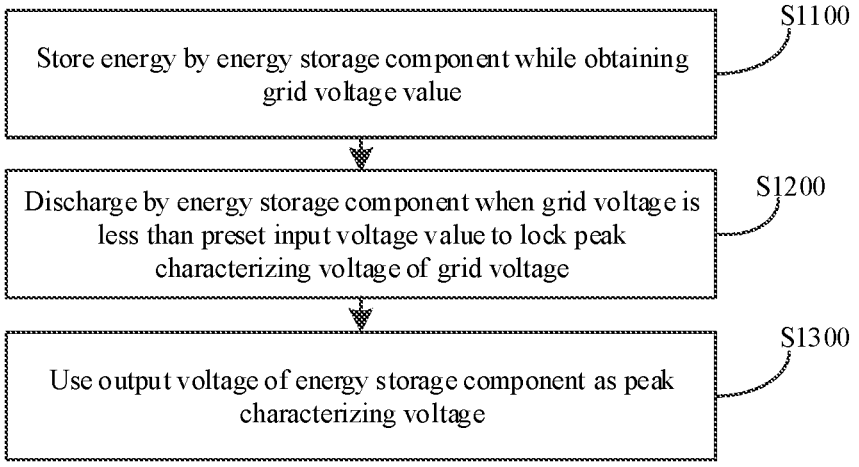
FIG. 2 is a flowchart of the way of obtaining the peak characterizing voltage according to the present application.

In an embodiment, referring to FIG. 2, the way of obtaining the peak characterizing voltage of the grid, includes:

S1100: storing energy by using an energy storage component while obtaining a grid voltage value;

S1200: discharging by the energy storage component when the grid voltage is less than a preset input voltage value, to lock the peak characterizing voltage of the grid voltage;

S1300: using an output voltage of the energy storage component as a peak characterizing voltage.

The voltage detection circuit can be configured to obtain the grid voltage value proportionally. Usually, the grid voltage value is obtained through a voltage divider circuit. In the present application, an energy storage component is connected to the circuit to obtain the grid voltage value and store the energy. When the stored energy reaches the maximum value, that is, when the grid voltage reaches the maximum value, the storing of the energy ends. When the grid voltage decreases, since the voltage value of the energy storage component is greater than the grid voltage, the energy storage component discharges electricity to still output this peak voltage within a period of time, which is equivalent to locking (maintaining) the peak voltage within a time range. The locked voltage is the output voltage of the energy storage component, which is called the peak characterizing voltage.

S2000: generating a switch control signal according to the peak characterizing voltage;

When the peak characterizing voltage is generated, the switch control signal is generated according to the magnitude of the peak characterizing voltage and the grid voltage. Herein, the switch control signal is a signal that controls the on or off of the switch device.

Figure 3:
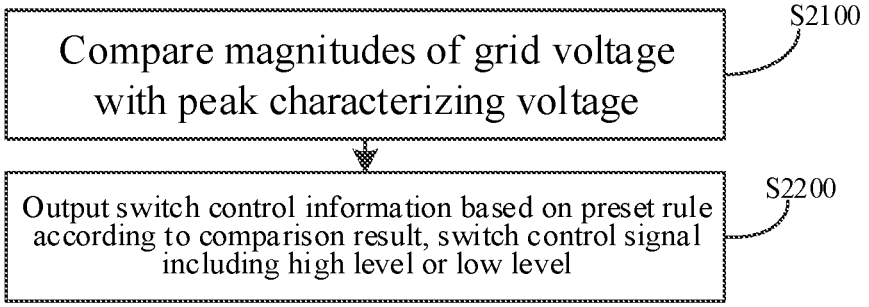
FIG. 3 is a flowchart of the way of generating a switch control signal according to the present application.

In an embodiment, referring to FIG. 3, the way of generating a switch control signal according to the peak characterizing voltage includes:

S2100: comparing magnitudes of the grid voltage with the peak characterizing voltage;

S2200: outputting switch control information based on a preset rule according to the comparison result, wherein the switch control signal includes a high level or a low level.

The generation of the switch control signal is generated by the change in the magnitude comparison between the detected peak characterizing voltage and the grid voltage. Since the grid voltage is a sine wave or a phase-cut sine wave in the process of turning on the LET lamp, the grid voltage will change with time, and there will be a peak value. In the circuit where the LED lamp is located, the peak characterizing voltage will also change with time, and there will be a maximum value. Under normal circumstances, in the process of increasing the grid voltage continuously, the peak characterizing voltage is also increasing continuously. Due to the loss of components itself, the grid voltage value will be higher than the peak characterizing voltage value. Since there is a peak characterizing voltage locking process in step S1000, the peak characterizing voltage is locked and maintained at the maximum value when the grid voltage enters a falling state after reaching the maximum value. Therefore, there will be a condition that the grid voltage is less than a peak characterizing voltage. Since the grid voltage reaches the peak state, the LED lamp has been turned on. Therefore, in the subsequent process that the LED lamp is maintained to be on, a switch control signal can be generated to control the turning off of the LED lamp to which it is connected, turning off the bleeder device, avoiding the bleeder current path persistently closed and reducing system efficiency.

Figure 4:
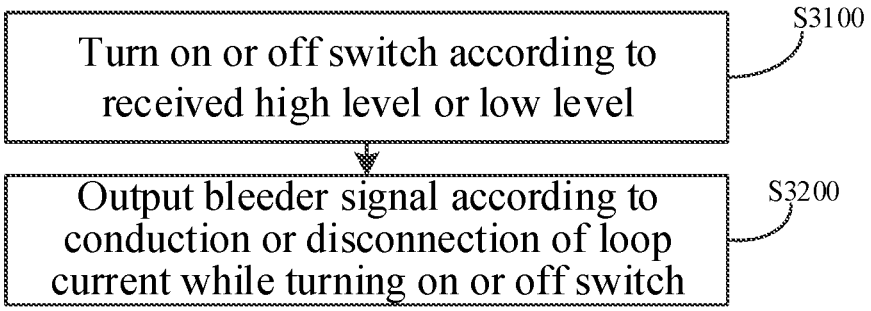
FIG. 4 is a flowchart of the way of generating a bleeder signal according to an embodiment of the present application.

S3000: performing switch control according to the switch control signal to generate a bleeder signal;

In one embodiment, the switch control signal may be a digital signal, and the switch device is controlled to be turned on or off by the digital signal. In another embodiment, the switch control signal is a current signal or a level signal, for example, a high level or a low level. In this embodiment, referring to FIG. 4, the way of performing switch control according to the switch control signal to generate a bleeder signal, includes:

S3100: turning on or turning off the switch according to the received high level or low level;

S3200: outputting the bleeder signal according to a conduction or disconnection of a loop current according to turning on or turning off of the switch.

The switch device can use a switch controlled by a low level or a high level. The switch is turned on at high level, turned off at low level; or turned off at high level, and turned on at low level. Specifically, when the switch device is a MOS transistor, the switch control signal is used as the gate end of the MOS transistor to control the conduction and disconnection of the MOS transistor.

S4000: performing bleeder control on the light source device according to the bleeder signal to connect or disconnect the circuit with the SCR in the light source device.

Figure 5:
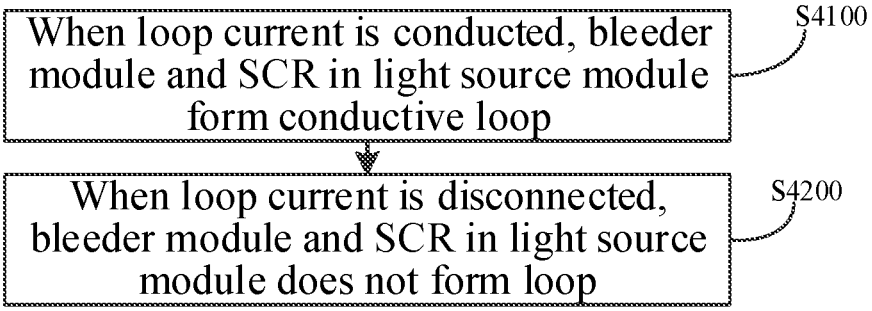
FIG. 5 is a flowchart of the way of performing bleeder control on a light source device according to a bleeder signal according to the present application.

In one embodiment, referring to FIG. 5, the way of performing bleeder control on the light source device according to the bleeder signal, includes:

S4100: when the loop current is conducted, the bleeder device and the SCR in the light source device form a conducted loop;

S4200: when the loop current is disconnected, the bleeder device and the SCR in the light source device does not form a loop.

Since the switch device is connected between the bleeder device and the light source device, a loop is formed among the SCR, the bleeder device, the switch device and the light source device. Therefore, the turning on and turning off of the switch device can control the turning on and turning off of the loop, to realize the dimming function of the light source device while avoiding the leakage current path from being persistently closed and reducing the system efficiency.

Figure 6:
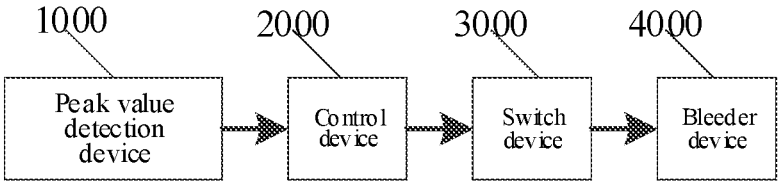
FIG. 6 is a schematic diagram of an adaptive control circuit device of the present application.
Figure 7:
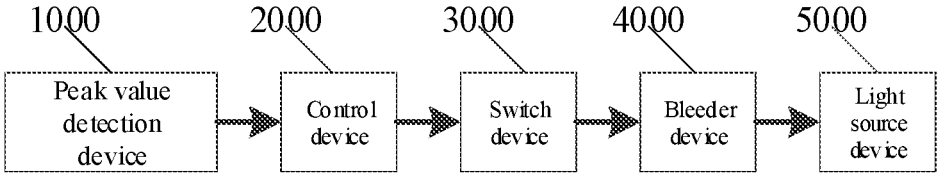
FIG. 7 is a schematic diagram of another device of the adaptive control circuit of the present application.

One embodiment of the present application discloses an adaptive bleeder control circuit. Referring to FIGS. 6 and 7, the circuit includes a peak detection device 1000, a control device 2000, a switch device 3000 and a bleeder device 4000, wherein the peak detection device 1000 is configured to detect the peak characterizing voltage of the grid, wherein the peak characterizing voltage is a voltage value that characterizes the peak state among the grid characterizing voltages detected within a preset time and scaled in proportion to magnitudes of grid voltages; the control device 2000 is connected to the peak detection device 1000, and configured to generate a switch control signal according to the peak characterizing voltage; the switch device 3000 is connected to the control device 2000, and configured to receive the switch control signal of the control device 2000 for switch control and generate a bleeder signal; the bleeder device 4000 is connected with the switch device 3000, and configured to receive the bleeder signal generated by the switch device 3000, perform bleeder control on the light source device 5000, and connect or disconnect the loop with the SCR in the light source device 5000.

In the present embodiment, the above adaptive bleeder control circuit is one of control circuits of the above adaptive bleeder control methods. The various devices in the implementation process of the adaptive bleeder control methods of the present application can be implemented by software controlling each integrated control device, or can be controlled by various circuit elements in a voltage-driven manner, or can be controlled in other manners.

Figure 8:
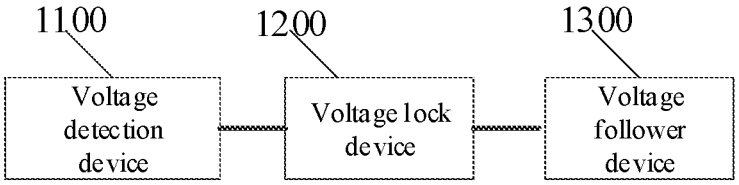
FIG. 8 is a schematic diagram of the connection of the peak detection device of the present application.

In an embodiment, referring to FIG. 8, the peak detection device 1000 includes a voltage detection device 1100, a voltage lock device 1200, and a voltage follower device 1300, wherein the voltage detection device 1100 is configured to detect the grid voltage; the voltage lock device 1200 is connected to the voltage detection device 1100, and configured to lock the peak characterizing voltage of the grid voltage and output the peak characterizing voltage under a preset condition; the voltage follower device 1300 is connected to the voltage lock device 1200 and configured to follow and output the peak characterizing voltage output by the voltage lock device 1200. Similarly, the voltage detection device 1100, voltage lock device 1200, and voltage follower device 1300 disclosed above can be implemented by software controlling each integrated control device, or can be controlled by various circuit elements in a voltage-driven manner or can be controlled in other manners.

Figure 9:
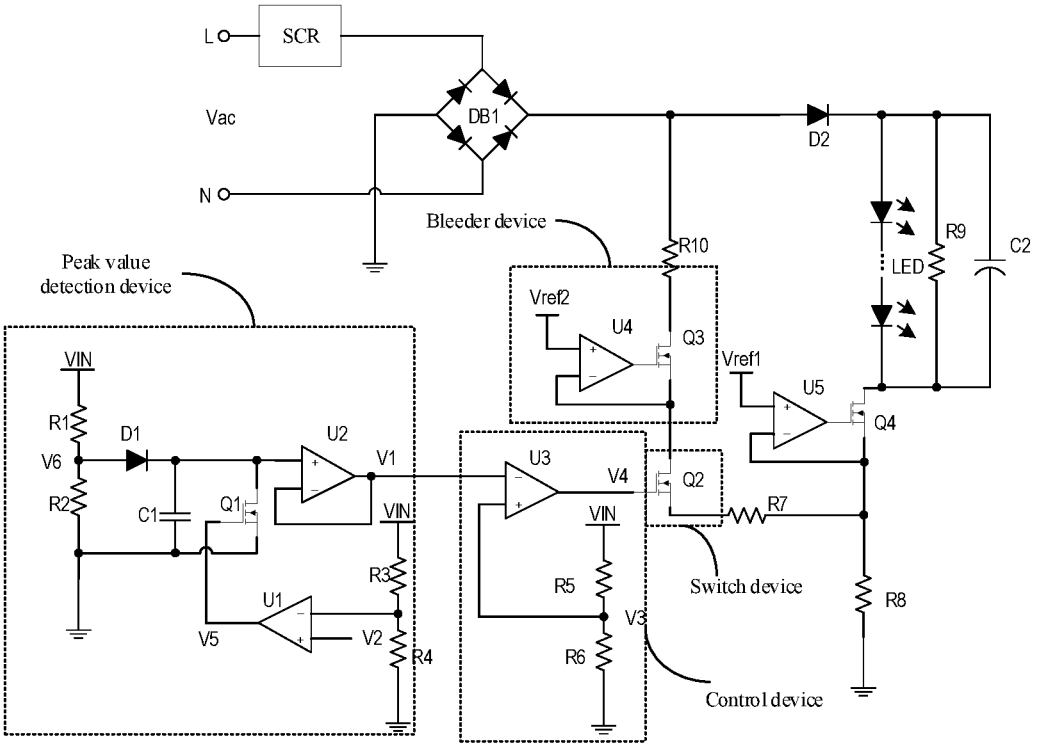
FIG. 9 is a circuit diagram of an adaptive bleeder control circuit of the present application.
Figure 10:
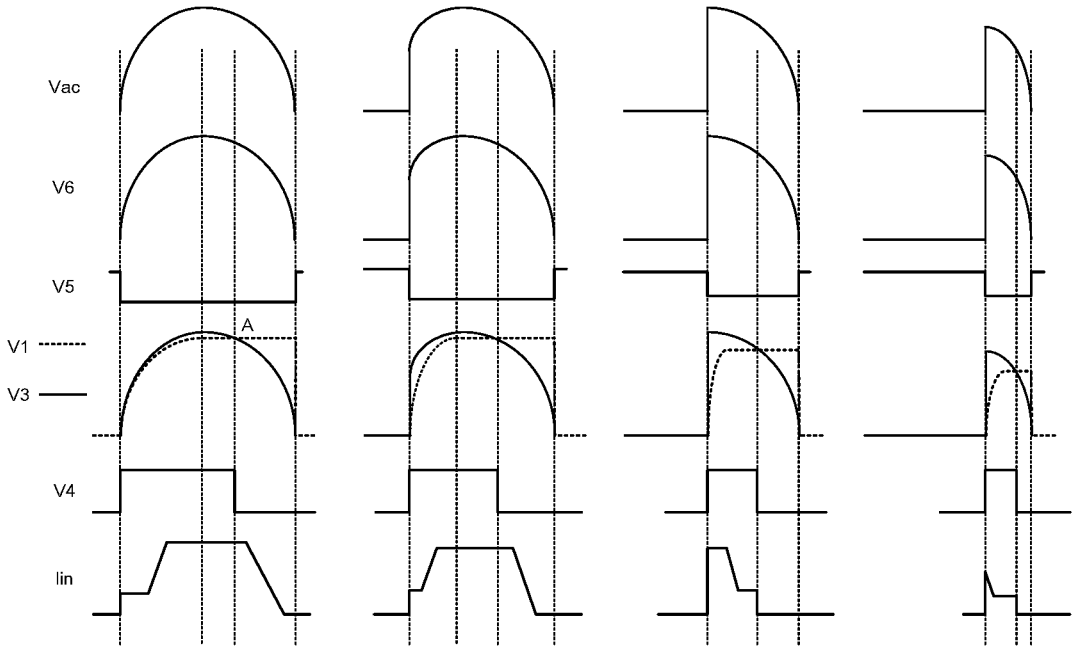
FIG. 10 is a schematic diagram of the voltage and current waveforms of the adaptive bleeder control circuit of the present application.

In one embodiment, referring to FIGS. 9 and 10, a circuit structure for controlling in a voltage-driven manner is disclosed. Specifically, the voltage detection device 1100 includes a first resistor R1, a second resistor R2, and a first resistor R2. The voltage lock device 1200 includes a first capacitor C1, a first MOS transistor Q1, a first comparator U1, a third resistor R3, and a fourth resistor R4. The voltage follower device 1300 includes a first voltage follower U2, a first end of the first resistor R1 is connected to the grid voltage Vac, and a second end of the first resistor R1 is respectively connected to an anode of the first diode D1 and a first end of the second resistor R2, a second end of the second resistor R2 is grounded, and a cathode of the first diode D1 is respectively connected to a first end of the first capacitor C1, a drain end of the first MOS transistor Q1 and a positive-phase input end of the first voltage follower U2, a second end of the first capacitor C1 is grounded, a source of the first MOS transistor Q1 is grounded, and a gate of the first MOS transistor Q1 is connected to an output end of the first comparator U1, a positive-phase input end of the first comparator U1 is connected to a preset input voltage V2, and a negative-phase input end of the first comparator U1 is respectively connected to a second end of the third resistor R3 and a first end of the fourth resistor R4, a first end of the third resistor R3 is connected to the grid voltage Vac, a second end of the fourth resistor R4 is grounded, and a negative-phase input end of the first voltage follower U2 is connected to an output end of the first voltage follower U2, and the output end of the first voltage follower U2 is connected to the control device 2000.

In this embodiment, the connection position V6 of the first resistor R1 and the second resistor R2 is used as the grid characterizing voltage. The grid characterizing voltage is a collected voltage scaled in proportion to the grid voltage Vac. A first diode D1 is provided between the first capacitor C1 and the first resistor R1 and the second resistor R2 to prevent the current from flowing backwards, the negative-phase input of the first comparator U1 is connected to the third resistor R3 and the fourth resistor R4 and is also used for collecting the grid characterizing voltage; the collected voltage characterizing voltage is also used for comparing with voltage V2 of the positive-phase input end, and when the voltage V2 is less than the grid characterizing voltage, the output end of the first comparator U1 outputs a low level at this time. That is, V5 is in a low-level state. Since the first comparator U1 is connected to the gate of the first MOS transistor Q1, in this case, the first MOS transistor Q1 is cut off. When the voltage of V2 is greater than the grid characterizing voltage, the output end of the first comparator U1 outputs a high level, that is, V5 is a high-level state. In this case, the first MOS transistor Q1 is turned on, the first capacitor C1 and the first MOS transistor Q1 form a loop, and the first capacitor C1 starts to discharge. In an embodiment, the voltage value of V2 can be 0, and in this case, the first comparator U1 is used as a zero-crossing comparator to compare whether the grid characterizing voltage value is greater than 0. If it is greater than 0, the first MOS transistor Q1 is cut off. If it is less than 0, the first MOS transistor Q1 is turned on. In this embodiment, the positive-phase input end of the first voltage follower U2 directly collects the voltage value from the first end of the first capacitor C1. The first voltage follower U2 is an operational amplifier as a voltage follower, and its voltage V1 of the output end is consistent with the voltage value input by the positive-phase input end. Therefore, the voltage value V1 of the output end is the voltage value of the first end of the first capacitor C1. When the grid voltage starts to input, the first capacitor C1 starts to charge. The change of the grid characterizing voltage V6 is consistent with the trend of magnitude of the grid voltage Vac. The voltage value of the first end of the first capacitor C1 increases with the amount of power charged by the first capacitor C1. When the voltage value of the first end is greater than the grid characterizing voltage V6, and in this case, due to the existence of the first diode D1, the first capacitor C1 is no longer charged, and since the grid characterizing voltage is not less than V2, the first MOS transistor is always cut off; the voltage value of the first end of the first capacitor C1 is locked, and the voltage value V1 output by the output end of the first voltage follower U2 is always the peak characterizing voltage. Before the grid voltage drops below the preset voltage value V2, there would be a condition where the peak characterizing voltage is greater than the grid characterizing voltage.

In one embodiment, the control device 2000 includes a second comparator U3, a fifth resistor R5, and a sixth resistor R6, wherein the negative-phase input end of the second comparator U3 is connected to the output end of the first voltage follower U2, the positive-phase input end of the second comparator U3 is respectively connected to the second end of the fifth resistor R5 and the first end of the sixth resistor R6, and the first end of the fifth resistor R5 is connected to the grid voltage, the second end of the sixth resistor R6 is grounded, and the output end of the second comparator U3 is connected to the switch device 3000. In the control device 2000, the voltage value compared by the second comparator U3 is the voltage V3 between the fifth resistor R5 and the sixth resistor R6 and the voltage V1 output from the output end of the first voltage follower U2. Since the voltage V3 is a grid characterizing voltage, voltage V1 is the voltage of the first end of the first capacitor C1, and the voltage output by the second comparator U3 is the voltage V4. According to the circuit diagram and the circuit waveform diagram, it can be seen that if the grid characterizing voltage V3 is greater than the voltage V1, the voltage V4 is at a high level, and if the grid characterizing voltage V3 is less than the voltage V1, the voltage V4 is at a low level, which the node where the voltage V4 changes from a high level to a low level is the position of point A in the circuit waveform diagram.

In one embodiment, the switch device 3000 includes a second MOS transistor Q2, the gate of the second MOS transistor Q2 is connected to the output end of the second comparator U3, and the source of the second MOS transistor Q2 is connected to the light source device 5000, the drain of the second MOS transistor Q2 is connected to the bleeder device 4000. Since the gate of the second MOS transistor Q2 is connected to the output end of the first voltage follower U2, if the V4 voltage is at a high level, the switch device is turned on, and if the voltage V4 is at a low level, the switch device 3000 is cut off.

In one embodiment, the bleeder device 4000 includes a second voltage follower U4 and a third MOS transistor Q3, wherein the positive-phase input end of the second voltage follower U4 is connected to a second reference voltage Vref2, and the output end of the second voltage follower is connected to the gate of the third MOS transistor Q3, and the source of the third MOS transistor Q3 is respectively connected to the negative-phase input end of the second voltage follower U4 and the drain of the second MOS transistor Q2, the drain of the third MOS transistor Q3 is connected to the light source device 5000 to form a loop with the SCR in the light source device 5000. Specifically, if the second MOS transistor Q2 in the switch device 3000 is conducted, then the SCR, the bleeder device 4000, the switch device 3000 and the light source device 5000 form a conducted loop, and if the second MOS transistor Q2 in the switch device 3000 is cut off, then the SCR, the bleeder device 4000, the switch device 3000 and the light source device 5000 are disconnected, and no loop is formed.

In an embodiment, the light source device 5000 includes a SCR, a rectifier bridge DB1, a second diode D2, an LED lamp, a seventh resistor R7, an eighth resistor R8, a ninth resistor R9, a tenth resistor R10, and a second capacitor C2, a fourth MOS transistor Q4 and a third voltage follower U5, wherein a first end of the SCR is connected to a live wire L in the grid voltage Vac, a second end is connected to a first end of the rectifier bridge DB1; a second end of the rectifier bridge DB1 is connected to the neutral line N of the grid voltage, a third end of the rectifier bridge DB1 is grounded, and a fourth end of the rectifier bridge DB1 is connected to a first end of a tenth resistor R10 and an anode of a second diode D2, and a second end of the tenth resistor R10 is connected to the drain of the third MOS transistor Q3, a cathode of the second diode D2 is connected to a first end of the LED lamp, a first end of a ninth resistor R9 and a first end of the second capacitor C2; a second end of the LED lamp, the second end of ninth resistor R9, the second end of the second capacitor C2 are respectively connected to the drain of the fourth MOS transistor Q4, and the gate of the fourth MOS transistor Q4 is connected to the output end of the third voltage follower U5. The positive-phase input end of the third voltage follower U5 is connected to the first reference voltage Vref1, the negative-phase input end of the third voltage follower U5 is connected to the source of the fourth MOS transistor Q4, and the source of the fourth MOS transistor Q4 is also connected to the second end of the seventh resistor R7 and the first end of the eighth resistor R8, the second end of the eighth resistor R8 is grounded, and the first end of the seventh resistor R7 is connected to the source of the second MOS transistor Q2.

Referring to the circuit diagram of FIG. 9 and the corresponding circuit waveform diagram of the phase-cutting state of various degrees in the LED lamp starting state of FIG. 10, the working principle of the adaptive bleeder control circuit disclosed in this application is to set a detection point of the grid voltage Vac in the peak detection device 1000 to detect the grid characterizing voltage. The grid characterizing voltages are the voltage V6 and the voltage V3. The voltage V1 at the output end of the first voltage follower U2 is the voltage value of the first end of the first capacitor C1. If the grid voltage is normally conducted, the first capacitor C1 is in a charging state, and the voltage V1 increases with the increase of the grid voltage. If the grid voltage decreases after reaching the peak value, in a case that the detected grid characterizing voltage V6 is less than the voltage on the first capacitor C1, it stops charging, and the voltage V1 remains at the peak state of the first capacitor C1, that is, the peak characterizing voltage. Since the voltage V3 is also the detection point for the grid voltage, that is the grid characterizing voltage, the second comparator U3 compares the grid characterizing voltage V3 with the voltage V1. If the grid characterizing voltage V3 is higher than the voltage V1, a high level is outputted, the second MOS transistor Q2 is conducted, and the bleeder device 4000 is connected to a loop of combination of the SCR, the switch device 3000 and the light source device 5000 to maintain the conduction of the SCR. If the main circuit current Tin at the position of the light source device 5000 is maintained at the maximum value, the LED lamp is fully activated and the SCR keeps the LED lamp on, subsequently the grid voltage value starts to decrease. If the voltage value of the grid characterizing voltage V3 is less than the voltage V1, the second voltage follower U3 outputs a low level, and in this case, the second MOS transistor Q2 in the switch device 3000 is turned off, and the loop between the bleeder device 4000 and the light source device 5000 is cut off, then the bleeder device being turned off. The present application uses the bleeder device to turn on and turn off the bleeder device according to the voltage of the grid to realize the dimming function of the light source device while avoiding the leakage current path from being persistently closed and reducing the system efficiency.

What is claimed is:

1. An adaptive bleeder control method, comprises:

obtaining a peak characterizing voltage of a grid, wherein the peak characterizing voltage is a voltage value that characterizes a peak state among grid characterizing voltages detected within a preset time and being scaled in proportion to magnitudes of grid voltages;

generating a switch control signal according to the peak characterizing voltage;

performing switch control according to the switch control signal, to generate a bleeder signal; and performing bleeder control on a light source module according to the bleeder signal, to connect or disconnect a loop with a silicon controlled rectifier (SCR) in the light source module, wherein the way of obtaining the peak characterizing voltage of the grid comprises:

storing energy by using an energy storage component while obtaining a grid voltage value;

discharging by the energy storage component when the grid voltage is less than a preset input voltage value, to lock the peak characterizing voltage of the grid voltage; and using an output voltage of the energy storage component as the peak characterizing voltage.

2. The adaptive bleeder control method according to claim 1, wherein the way of generating a switch control signal according to the peak characterizing voltage, comprises:

comparing magnitudes of the grid voltage with the peak characterizing voltage; and outputting switch control information based on a preset rule according to a comparison result, wherein the switch control signal comprises a high level or a low level.

3. The adaptive bleeder control method according to claim 2, wherein the way of performing switch control according to the switch control signal to generate a bleeder signal comprises:

turning on or turning off the switch according to the received high level or low level;

outputting the bleeder signal according to a conduction or disconnection of a loop current while turning on or turning off the switch.

4. The adaptive bleeder control method according to claim 3, wherein the way of performing bleeder control on the light source module according to the bleeder signal, comprises:

when the loop current is conducted, the bleeder module and the SCR in the light source module form a conducting loop; and when the loop current is disconnected, the bleeder module and the SCR in the light source module does not form a loop.

5. An adaptive bleeder control circuit, comprises:

a peak value detection module configured to detect a peak characterizing voltage of a grid, wherein the peak characterizing voltage is a voltage value that characterizes a peak state among grid characterizing voltages detected within a preset time and being scaled in proportion to magnitudes of grid voltages;

a control module connected to the peak detection module, configured to generate a switch control signal according to the peak characterizing voltage;

a switch module connected to the control module and configured to receive the switch control signal from the control module, perform switch control, and generate a bleeder signal; and a bleeder module connected to the switch module, and configured to receive the bleeder signal generated by the switch module, and perform bleeder control on a light source module to connect or disconnect a loop with a silicon controlled rectifier (SCR) in the light source module, wherein the peak detection module comprises:

a voltage detection unit, configured to detect a grid voltage;

a voltage lock unit, connected to the voltage detection unit, and configured to lock a peak characterizing voltage of the grid voltage and output the peak characterizing voltage under a preset condition; and a voltage follower unit, connected to the voltage lock unit, and configured to follow and output the peak characterizing voltage output by the voltage lock unit.

6. The adaptive bleeder control circuit according to claim 5, wherein the voltage detection unit comprises a first resistor, a second resistor and a first diode, the voltage lock unit comprises a first capacitor, a first MOS transistor, a first comparator, a third resistor, and a fourth resistor, and the voltage follower unit comprises a first voltage follower, and wherein, a first end of the first resistor is connected to the grid voltage, and a second end of the first resistor is respectively connected to an anode of the first diode and a first end of the second resistor, a second end of the second resistor is grounded, a cathode of the first diode is respectively connected to a first end of the first capacitor, a drain end of the first MOS transistor and a positive-phase input end of the first voltage follower, a second end of the first capacitor is grounded, a source of the first MOS transistor is grounded, and a first gate of the first MOS transistor is connected to an output end of the first comparator, the positive-phase input end of the first comparator is connected to a preset input voltage, and the negative-phase input end of the first comparator is respectively connected to a second end of the third resistor and a first end of the fourth resistor, the first end of the third resistor is connected to the grid voltage, the second end of the fourth resistor is grounded, the negative-phase input end of the first voltage follower is connected to the output end of the first voltage follower, and the output end of the first voltage follower is connected to the control module.

7. The adaptive bleeder control circuit according to claim 6, wherein the control module comprises a second comparator, a fifth resistor, and a sixth resistor, and wherein, a negative-phase input end of the second comparator is connected to the output end of the first voltage follower, the positive-phase input end of the second comparator is respectively connected to a second end of the fifth resistor and a first end of the sixth resistor, a first end of the fifth resistor is connected to the grid voltage, a second end of the six resistor is grounded, and an output end of the second comparator is connected to the switch module.

8. The adaptive bleeder control circuit according to claim 7, wherein the switch module comprises a second MOS transistor, wherein a gate of the second MOS transistor is connected to the output end of the second comparator, and a source of the second MOS transistor is connected to a light source module, and a drain of the second MOS transistor is connected to the bleeder module.

9. The adaptive bleeder control circuit according to claim 8, wherein the bleeder module comprises a second voltage follower and a third MOS transistor, wherein a positive-phase input end of the second voltage follower is connected to a reference voltage, an output end of the second voltage follower is connected to a gate of the third MOS transistor, a source of the third MOS transistor is respectively connected to a negative-phase input end of the second voltage follower and a drain of the second MOS transistor, and a drain of the third MOS transistor is connected to the light source module to form a loop with the SCR in the light source module.

* * * * *